US005716150A

United States Patent [19]

Gueret

[11] Patent Number: 5,716,150

[45] Date of Patent: Feb. 10, 1998

[54] APPLICATOR UNIT FOR A PRODUCT OF A PASTY OR POWDERY CONSISTENCY SUCH AS LIP ROUGE

[75] Inventor: Jean-Louis H. Gueret, Paris, France

[73] Assignee: L'Oreal, Paris, France

[21] Appl. No.: 675,150

[22] Filed: Jul. 3, 1996

[30] Foreign Application Priority Data

Jul. 5, 1995 [FR] France ..... 95 08131

[51] Int. Cl.[6] ..... A45D 40/00; A45D 40/26

[52] U.S. Cl. ..... 401/129; 401/128; 401/130

[58] Field of Search ..... 401/128, 129, 401/130

[56] References Cited

U.S. PATENT DOCUMENTS

| | | | |
|---|---|---|---|
| Re. 21,757 | 4/1941 | Deakers et al. | 401/128 X |
| 1,909,096 | 5/1933 | Cooney | 401/130 |
| 2,158,901 | 5/1939 | Gordon . | |
| 2,298,534 | 10/1942 | Kaye | 401/128 |
| 3,087,191 | 4/1963 | Plunkett | 401/130 |
| 3,554,657 | 1/1971 | Aston . | |
| 4,403,624 | 9/1983 | Montgomery | 401/129 X |
| 4,437,477 | 3/1984 | Gueret | 401/128 X |
| 4,796,647 | 1/1989 | Gueret | 401/129 X |
| 5,123,431 | 6/1992 | Wilson | 401/130 X |
| 5,490,737 | 2/1996 | Gueret | 401/129 X |

FOREIGN PATENT DOCUMENTS

| | | |
|---|---|---|
| 0 354 823 | 2/1990 | European Pat. Off. . |
| 0 627 182 | 12/1994 | European Pat. Off. . |
| 2 603 780 | 3/1988 | France . |

*Primary Examiner*—Steven A. Bratlie

*Attorney, Agent, or Firm*—Young & Thompson

[57] ABSTRACT

A applicator unit (1) for a product (P) of a pasty or powdery consistency. The applicator includes a stem (12) having a first free end (14) joined to an applicator end fitting (16) in contact with the product and being intended for the application of this product to a surface to be treated, a second end (18) of the stem (12) being joined to a gripping element (6), wherein the applicator end fitting (16) has a flexible central core (20) having in at least one portion close to its end part (17) a diameter of 0.2 mm to 2 mm, and wherein the core (20) is covered over its whole circumference by a covering (22) capable of picking up the product (P).

20 Claims, 1 Drawing Sheet

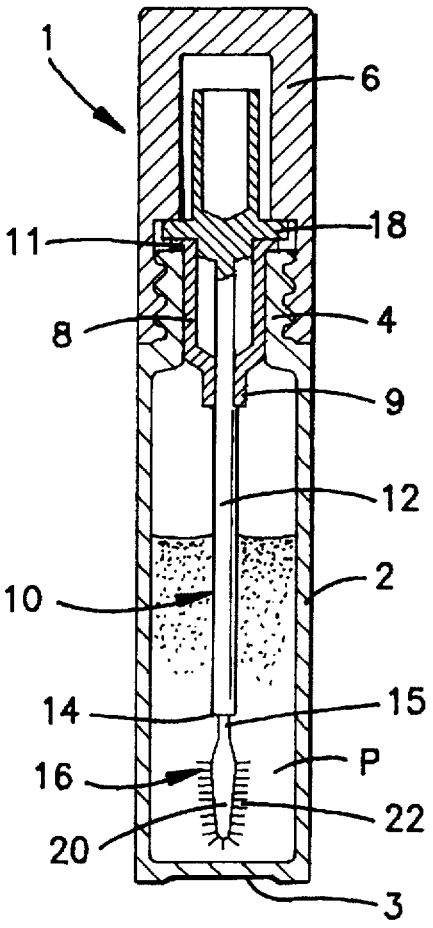
FIG. 1
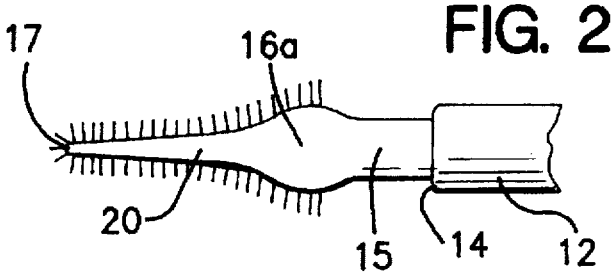
FIG. 2
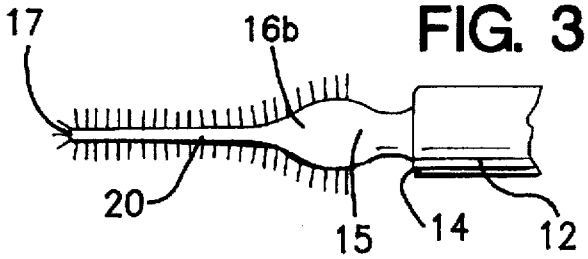
FIG. 3
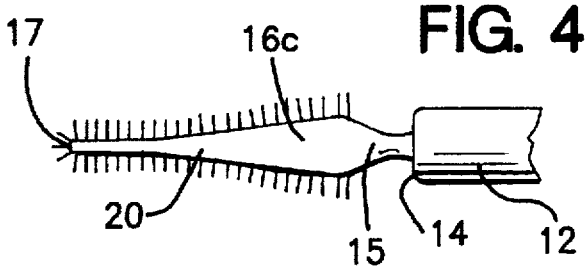
FIG. 4
FIG. 5
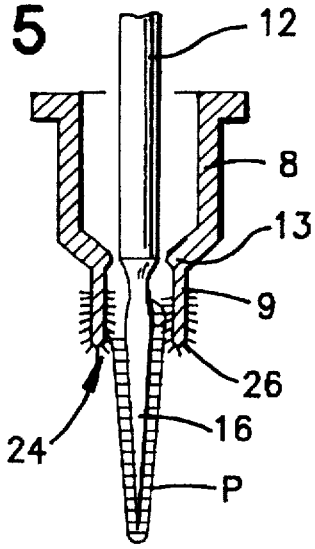
FIG. 6
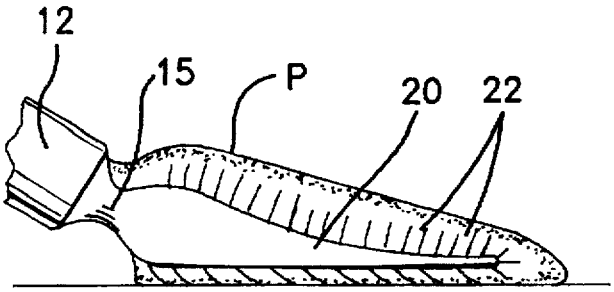

APPLICATOR UNIT FOR A PRODUCT OF A PASTY OR POWDERY CONSISTENCY SUCH AS LIP ROUGE

The present invention relates to an element and a unit for the application of a product of a pasty or powdery consistency, comprising a soft and flexible applicator end fitting. This unit is, more particularly, intended for the storage and the application of a viscous product, in particular a cosmetic product, such as a make-up cream, a cheek blusher, a lip make-up or an eye shadow, or yet again a paste of lip rouge or lip-gloss.

Products of a pasty consistency intended in particular for application to the lips are generally packaged in reservoirs of an elongate shape and of a small size, provided with an applicator or applicator element; the reservoir-product-applicator unit is generally called an applicator unit.

FR-A-2-127 644 and US-A-3 002 517 describe an applicator unit for a paste of lip rouge, provided with an applicator element in the form of a hollow brush. This unit does not permit easy spreading of the paste on the lips. Moreover, it leads to obtaining a matt and non-homogeneous product layer on the lips. Finally, this applicator unit does not ensure a sufficiently precise make-up, in particular of the outlines of the lips. These drawbacks are generally ill-received by the user.

Moreover, applicator units are known in the trade for the application of pasty products comprising as the applicator element, a hollow cylindrical element provided with a central duct for feeding the product; the end of this end fitting is made of a rigid material covered by a flock coating and is cut at a slant. The slanting surface is impregnated with the product, thanks to the central duct and constitutes the spreading surface.

This applicator element does not permit a precise make-up of the lips either. Moreover, in spite of the flock coating, the user feels an unpleasant stiffness when the product is applied. This stiffness entails, in particular, the deposit of too thin a product layer with inadequate coverage, more particularly in the middle of the lips. Moreover, this layer has unsightly streaks at the edges of the lips. Finally, the latter has a non-homogeneous and non-glossy appearance.

Thus the object of the present invention is an applicator element for a viscous or powdery product, making it in particular possible to avoid the above mentioned drawbacks, and in particular ensuring a pleasing make-up, yet being soft. This element can be used for the application of any viscous product to any base with a view to obtaining the deposit of a homogeneous product layer on the base. Apart from making-up, the element of the invention can be used for applying an adhesive film coating to a base.

It has surprisingly been found that, by using a supple or semi-rigid end fitting with a small diameter and comprising a flock coating with a specified property, it was possible to obtain a precise and homogeneous make-up of the lips with a pleasing and glossy appearance.

Moreover, the applicator element in accordance with the invention comprising such an end fitting permits the use of highly pigmented lip rouge pastes whose application produces a very satisfactory result contrary to the applicator elements of the prior art. Indeed, the latter are in no way suitable for this kind of product.

Thus a first aspect of the invention provides an applicator element for a product of a pasty consistency, comprising a gripping element; and a stem having a first free end joined to an applicator end fitting intended for the taking up of the product and the application of this product to a surface to be treated, and a second end of the stem joined to the gripping element; characterized in that the applicator end fitting has a flexible central core having, in at least one portion close to its end part, a diameter of 0.2 mm to 2 mm; and in that this core is covered over its whole or part of its periphery by a covering capable of picking up the product.

In addition to the advantages mentioned above, the applicator element has, surprisingly, a holding capacity of the charged product that is sufficient for ensuring an appropriate make-up of the two lips when the product is a lip rouge paste. Indeed, by slightly rotating the applicator element against the lips, the user utilizes the whole of the product held on the end fitting. By subsequently applying this end fitting perpendicularly to the lips, a homogeneous spread of the product is obtained on the lips, since the supple zones of the end fitting allow the formation of streaks to be avoided. By finally applying this applicator element to the outline of the lips in the manner of a brush, it is possible to draw the outline of the lips with great accuracy. The applicator element of the invention thus makes it possible to draw the outline of the lips and to color the lips with a single device, which is contrary to the prior art. It advantageously replaces both the lip pencil and the lipstick. Preferably, the diameter of this end fitting is approximately 0.2 mm to 1.5 mm, and more particularly 0.4 mm to 0.6 mm, at least in a portion close to its end part.

Advantageously, the end fitting is made from a flexible or semi-rigid elastomeric material. Preferably, this material may be constituted by an elastomer whose Shore A hardness is of the order of 25 to 40, chosen from the group of thermoplastic materials, thermoplastic elastomers, natural and synthetic rubbers. If required, this applicator end fitting may be a honeycombed foam with open or closed cells.

The suppleness of the end fitting may be obtained either by the choice of the material constituting it, or by the shape of the said end fitting. It is also possible to act on the two aspects, which permits the use of flexible or semirigid materials. Preferably, the covering of the applicator end fitting is a flock covering of natural or synthetic fibers, such as fibers of cotton, polyamide, polyester etc. Generally, these fibers have a diameter of approximately 50 μm to 250 μm. Advantageously, their length is approximately 0.3 mm to 2 mm.

Preferably, the applicator end fitting has a cross-section chosen from circular, triangular and oval cross-sections. Moreover, so as to obtain a greater bearing surface on the base to be coated, the end fitting may be curved and thus has the shape of a winkle-picker. This shape facilitates the make-up of the upper lips still while also favoring the precision of the outline.

Preferably, the diameter of the applicator end fitting, at least in a portion close to its end part measured up to the surface of the flock covering, is at least three times greater than the diameter of the core itself, at least in a portion close to its end part.

Thus the diameter of the applicator end fitting charged with the product, at least in a portion close to its end part, is preferably at least four times greater than the diameter of the core of the applicator.

A further aspect of the invention also provides a unit for the application of a product of a pasty consistency, comprising a reservoir for the product, provided with a neck and an applicator element, characterized in that the applicator element is in accordance with the first aspect described above, the gripping element of the applicator element then being mounted on the neck of the reservoir.

This applicator unit may, moreover, comprise an annular wiper element fixed to the neck of the reservoir and traversed by the stem, this element being capable of wiping this stem and/or the applicator end fitting. Advantageously, this wiper element has the shape of a glove finger provided with a central passage opening, it being possible for this opening or the wiping part of this wiper (the case of a double wiper) to have also been given a flock coating.

In the applicator unit, the applicator end fitting is submerged in the product. During use, the applicator is withdrawn from the reservoir after having passed through the wiper element; the latter thus ensures that the product is homogeneously spread over the applicator end fitting.

The applicator element and unit thus constituted can be used for the application of products having a viscosity ranging from 5 cp to 80 cp ($5.10^{-3}$ Pa.s to $80.10^{-3}$ Pa.s). This product is preferably a paste of lip rouge or an eye shadow.

Thus yet a further aspect of the invention also provides a unit for the application of lip rouge paste, comprising a paste reservoir provided with a neck and an applicator element, characterized in that the applicator element is in accordance with the first aspect described above, the gripping element of the said element then being mounted on the neck of the reservoir.

To render the present invention more readily understood, several modes of embodiments will be described below by way of purely illustrative and non-restrictive examples of applicators and applicator units in accordance with the invention, represented in the attached drawing, in which:

FIG.1 represents an axial section of an applicator unit in accordance with the invention in its storage position;

FIGS. 2 to 4 show three embodiments of the applicator end fitting on an enlarged scale;

FIG. 5 represents an enlarged axial section of FIG. 1, showing the wiper element and the applicator end fitting in the extraction stage; and FIG. 6 is an enlarged view of the applicator end fitting in the course of use.

In FIG. 1, an applicator unit in accordance with the invention has been designated by the reference numeral 1. It comprises a reservoir 2 of a cylindrical shape closed by a bottom 3. At its end opposite to the bottom 3, the reservoir is extended in a neck 4 with a diameter smaller than that of the reservoir. The neck 4 bears an external thread cooperating with an internal thread of a cylindrical handle 6 which serves as an element for gripping an applicator 10 permanently submerged in the product P when the handle 6 is fixed on the neck 4 of the reservoir. This product is, for example, a coloured cream of a viscous consistency for the lips.

In the handle 6, there is fixed a stem 12 having a radial extension 18, of substantially the same diameter as the neck 4 and situated inside the handle. The applicator supported by one of the ends of the stem may be moulded therewith and then be flocked. The applicator may also be catch engaged, bonded or welded in the stem.

A wiper element 8 in the form of a glove finger, having at the end nearer the reservoir a circular wiper lip 9, is inserted into the neck. At the opposite end this glove finger 8 has a flange 11 extending radially towards the outside, this flange thus resting on the neck 4 of the reservoir. In the assembled position of the unit 1, the flange 11 comes to bear against the radial extension 18 of the stem, thus performing the function of a gasket. The wiper element 8 is constituted by an elastomeric material which can be chosen from the thermoplastic elastomers and natural or synthetic rubbers.

The stem 12 has a diameter of approximately 3 mm. Its free end carries an elongate conical applicator end fitting 16 which has a tip-shaped end part 17. This end fitting is moulded of a thermoplastic material, for example, of polyurethane. It is fixed to the stem by thermowelding, bonding or any other suitable means. The surface of the end fitting is partly, or even completely, covered by a flock coating of fibers of polyamide, of rayon, of cotton having a diameter of approximately 70 μm and a length of approximately 1.2 mm.

A zone 15 for connecting the end fitting 16 is provided near the end 14. It has a reduced cross-section imparting great softness to the end fitting during the application of the product P to the lips.

FIGS. 2 to 4 show on an enlarged scale three embodiments of the applicator end fitting (16*a*, 16*b*, 16*c*). It will be seen that each end fitting has a central core 20 having a tapered end part 17. In the embodiments of FIGS. 16*a* and 16*b*, the end fitting is generally carrot-shaped; the embodiment of FIG. 3 is, moreover, slimmer than that of FIG. 2. In FIG. 4, the end fitting has the form of an elongate cone whose tip 17 is tapered. A shape in the form of a winkle-picker may also be envisaged.

The length of the end fitting 16 is approximately 8 mm to 22 mm. This end fitting 16 may have a circular, triangular or oval cross-section. The diameter of its end part 17 may vary from 0.2 mm to 2 mm; it is preferably comprised in the span ranging from 0.2 mm to 1.5 mm and more particularly from 0.4 mm to 0.6 mm.

FIG. 5 shows the wiper element 8 with the applicator end fitting 16 in the extraction stage. It will be seen that the element 8 has an internal bead 13 intended to wipe the stem 12 of the applicator. The wiper lip 9 is provided with a flock coating 26 whose internal diameter 24 is dimensioned in such a way that the flocked wiper lip surface 26 effects a homogeneous spreading of the product on this end fitting 16 during the extraction of the end fitting 16 from the reservoir 2.

FIG. 6 illustrates the application of the product P to a surface, for example, the lips. It will be seen that thanks to the suppleness of the end fitting 16, the latter follows the surface to be made up. Moreover, the making up is effected in a very soft manner. By means of this applicator, the user is able to effect a precise and homogeneous making up of her lips, having a pleasing and glossy appearance. Moreover, the applicator 16 can contain enough of the product to effect the making up of two lips, without the need to dip the applicator again into the reservoir 2. This allows time to be saved when making up.

I claim:

1. An applicator element (1) for a product (P) of a pasty or powdery consistency, comprising: a gripping element (6); and a stem (12) having a first free end (14) joined to an applicator end fitting (16) intended for the taking up of the product and the application of this product to a surface to be treated, and a second end (18) of the stem being joined to the gripping element (6), the applicator end fitting (16) joining the stem at a neck narrower than the stem, and having a bulbous portion wider than the neck connected to the neck, and having a flexible central core (20) connected to the bulbous portion which has a diameter of 0.2 mm to 2 mm, this core (20) being covered over the whole of its circumference by fibers (22) capable of picking up the product (P) wherein the diameter of the applicator end fitting (16), at least in the central core measured out to ends of the fibers, is at least three times greater than the diameter of the core (20).

2. An element according to claim 1, wherein the diameter of the applicator end fitting (16) charged with the product (P), at least in the central core, is at least four times greater than the diameter of the central core.

3. An element according to claim 1, wherein the central core (20) of the applicator end fitting (16) has a diameter of 0.2 mm to 1.5 mm.

4. An element according to claim 1, wherein the flexible central core (20) of the applicator end fitting (16) has a diameter of 0.4 mm to 0.6 mm.

5. An element according to claim 1, wherein the applicator end fitting (16) is made of a supple elastomeric material.

6. An element according to claim 1, wherein the applicator end fitting (16) is made of a honeycombed foam.

7. An element according to claim 1, wherein said fibers have a length of approximately 0.3 to 2 mm.

8. An element according to claim 1, wherein the end fitting has a curved shape.

9. The element according to claim 1, further comprising a reservoir (2) for the product (P) which is provided with a neck (4) wherein the gripping element (6) of the said applicator element is mounted on the neck (4).

10. The element according to claim 1, wherein the product is one of an eye shadow and lip rouge.

11. The element according to claim 9, further comprising an annular wiper element (8) fixed to the neck of the reservoir (2), traversed by the stem (12) for wiping this stem (12) and the applicator end fitting (16).

12. The element according to claim 11, wherein the wiper element (8) has the shape of a glove finger provided with a central passage opening (24), this opening having a flock coating (26).

13. The element according to claim 1, wherein the product (P) has a viscosity ranging from $5.10^{-3}$ Pa.s to $80.10^{-3}$ Pa.s.

14. The applicator element of claim 1, wherein the diameter of said central core is substantially constant and wherein said central core has an axial length which is between one quarter and one half of an axial length of said end fitting.

15. An applicator unit for dispensing a viscous or powdery product, the applicator comprising:

a reservoir for storing the product; and an applicator for immersion in the product stored in said reservoir, said applicator comprising an elongated cylindrical stem having a first end which extends from said reservoir and a second end immersed in the product stored in said reservoir when said applicator is inserted therein, and an end fitting affixed to said second end, said end fitting comprising, a first portion connected to said second end of said stem and which has a concavity with a minimum first diameter less than a diameter of said stem for imparting flexibility to said end fitting, a middle portion connected to said first portion which has a convexity with a maximum second diameter larger than said first diameter and less than the diameter of said stem, said middle portion tapering from said second diameter to a third diameter of 0.2 to 2 mm in a direction away from said stem, said third diameter being smaller than said first and second diameters and substantially smaller than the diameter of said stem, a flexible tip portion which has said third diameter adjacent said middle portion and which has a distal end with a diameter no greater than said third diameter, and said middle and tip portions being substantially covered about their entire circumferences with a flock coating of fibers extending generally orthogonally therefrom for accumulating the product stored in said reservoir when said applicator is immersed in the product in said reservoir.

16. The applicator unit of claim 15, wherein said fibers extend from said convexity to a diameter larger than the diameter of said stem and extend from said tip portion to a diameter no larger than the diameter of the stem.

17. The applicator unit of claim 16, wherein said reservoir comprises a neck with an annular wiper element through which said stem is inserted, said wiper element having an internal diameter at least as large as the diameter of said stem for leaving an accumulation of the product on said fibers at said tip portion out to a diameter which is substantially the same as said internal diameter of said wiper element.

18. The applicator unit of claim 17, wherein said internal diameter of said wiper element is at least four times larger than said third diameter.

19. The applicator unit of claim 15, wherein the diameter of said tip portion is substantially constant and wherein said tip portion has an axial length which is between one quarter and one half of an axial length of said end fitting.

20. The applicator unit of claim 19, wherein said fibers extend from said flexible tip portion to a diameter at least three times larger than said third diameter.

* * * * *